US005090075A

United States Patent [19]

Larson

[11] Patent Number: 5,090,075

[45] Date of Patent: Feb. 25, 1992

[54] WATERBED DRAINING SYSTEM INCLUDING VACUUM RELIEF VALVE

[76] Inventor: Lynn D. Larson, 1052 N. Lakeshore Dr., Lincoln, Nebr. 68528

[21] Appl. No.: 693,149

[22] Filed: Apr. 29, 1991

[51] Int. Cl.[5] ..... A47C 27/08

[52] U.S. Cl. ..... 5/451; 5/658; 141/7; 141/65; 141/114

[58] Field of Search ..... 5/451, 450, 449, 422, 5/508; 137/587; 141/1, 7, 65, 114

[56] References Cited

U.S. PATENT DOCUMENTS

| | | | |
|---|---|---|---|
| 3,797,538 | 3/1974 | Mollura | 5/451 |
| 4,073,019 | 2/1978 | Fraser | 5/451 |
| 4,399,576 | 8/1983 | Callaway | 5/451 |
| 4,611,357 | 9/1986 | Chelin | 5/451 |
| 4,996,760 | 3/1991 | Coleman | 29/454 |

OTHER PUBLICATIONS

"Simple Siphon" an Ad in the Aug. 1985 issue of Waterbed Magazine.

*Primary Examiner*—Alexander Grosz
*Attorney, Agent, or Firm*—John A. Beehner

[57] ABSTRACT

A waterbed draining system utilizes a vacuum relief valve operatively associated with a waterbed mattress bladder, or alternatively with the drain hose or water pump, to automatically provide air flow into the bladder upon the vacuum pressure within the bladder exceeding a predetermined level. The vacuum relief valve automatically bleeds air back into the bladder as needed to effect more complete drainage than was heretofore possible with conventional systems and without any need for operator assistance.

18 Claims, 3 Drawing Sheets

WATERBED DRAINING SYSTEM INCLUDING VACUUM RELIEF VALVE

BACKGROUND OF THE INVENTION

The present invention is directed generally to an improved system for draining a waterbed mattress and more particularly to a system which includes a vacuum relief valve in communication with either the mattress bladder or hose for bleeding air into the mattress when the vacuum pressure within the mattress exceeds a predetermined level.

Draining water from a waterbed mattress is conventionally accomplished by connecting a hose between the mattress filler opening and the inlet port of a water pump, connecting another hose between the outlet port of the water pump and a drain and operating the pump to draw water from the mattress. The problem is that this system, if started and left unattended, will generally leave approximately ten gallons of water in the mattress, with the result that the emptied mattress may weigh approximately one hundred ten pounds (110 lbs.) and have substantial volume, in large part due to the water contained therein.

It is known that improved draining of the waterbed mattress can be accomplished by letting a limited amount of air back into the mattress. This has generally been done by manipulating the connection between the hose and mattress to partially bleed the vacuum created within the mattress. The problem with this procedure is that if too much air is allowed in, the pump looses its prime and can no longer function. Furthermore, it requires the time and attention of the operator to monitor and skillfully adjust the hose connection. Such a manual bleeding of the mattress to allow air in is likely to reduce the finished weight of the mattress from one hundred ten pounds (110 lbs.) to approximately seventy pounds (70 lbs).

A primary object of the present invention is, therefore, to provide an improved waterbed draining system.

Another object is to provide a waterbed draining system including a vacuum relief valve in communication with the mattress bladder to automatically regulate the amount of air that is let back into the mattress.

Another object is to provide a waterbed draining system which can operate efficiently to effect maximum draining of the waterbed mattress.

Another object is to provide a waterbed draining system which operates independently without the attention of an operator.

Another object is to provide such a draining system which accommodates draining of a mattress both with a pump and by a siphon.

Another object is to provide a waterbed draining system including a vacuum relief valve which is built into the mattress so that it will not be lost or detached from the mattress.

Another object is to provide such a waterbed draining system which is simple and rugged in construction, economical to manufacture and efficient in operation.

SUMMARY OF THE INVENTION

The waterbed draining system of the invention provides a vacuum relief valve in communication with the interior of a waterbed mattress bladder to automatically provide air flow into the bladder upon the vacuum pressure therein exceeding a predetermined level. The vacuum relief valve may be attached to the bladder directly so as to be a permanent part of the mattress that cannot be detached and lost. Alternatively, the vacuum relief valve could be mounted on either the drain hose or a filler opening insert fitting for the drain hose. In either case, vacuum pressure would build up within a mattress being drained to a point where further drainage would be arrested until the vacuum pressure can be releaved. The vacuum relief valve automatically bleeds air back into the mattress when the vacuum pressure exceeds a predetermined level so that draining may continue automatically without operator assistance to achieve substantially complete draining with less than two gallons left in the mattress and with the drained mattress weighing approximately fifty pounds (50 lbs.) or less.

The invention, furthermore, contemplates a method of draining water from a filled waterbed mattress bladder, including the steps of connecting one end of a hose to the inlet port of a water pump and connecting the opposite end to the filler opening of the bladder in sealed relation for drawing water from the bladder through the filler opening and hose, providing a vacuum relief valve in operative association with at least one of the bladder, hose, and pump, operating the pump to drain water from the bladder through the hose and automatically introducing air into the bladder through the vacuum relief valve upon the vacuum pressure within the bladder exceeding a predetermined level.

The predetermined level of vacuum pressure which causes the vacuum relief valve to bleed air into the mattress is preferably between 5 and 15" of mercury vacuum pressure. In one embodiment, the predetermined level was approximately four pounds (4 psi) per square inch vacuum pressure.

The vacuum relief valve is preferably permanently mounted in the top wall of the bladder but may alternately be mounted on the drain hose, drain insert for attachment of the hose to the mattress filler opening, or on the water pump itself, so long as it is operative to provide air flow into the bladder when the vacuum pressure therein exceeds a predetermined level.

DESCRIPTION OF THE PREFERRED EMBODIMENT

Figure 1:
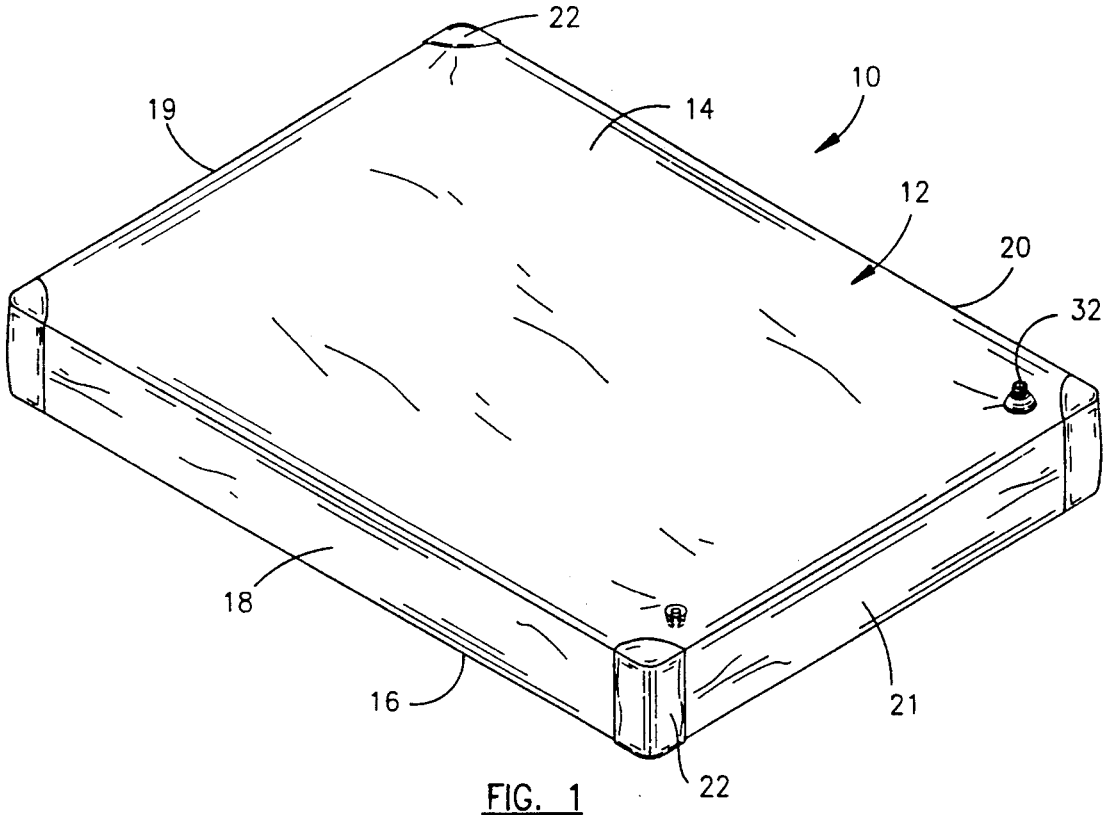
FIG. 1 is a perspective view of a waterbed mattress including a vacuum relief valve on the top wall of the mattress bladder.

The present invention is directed to a system for more efficiently draining water from a waterbed mattress 10, illustrated in FIG. 1 as including a bladder 12 having a top wall 14, bottom wall 16 and peripheral sidewalls 18, 19, 20 and 21. In its actual formation, the bladder 12 may have Corner openings that are closed and sealed by corner caps 22, but for purposes of the present invention, the top surface of the corner cap shall be regarded as part of the top wall 14 and each sidewall of a corner cap shall be regarded as part of the sidewall to which it is attached.

Figure 2:
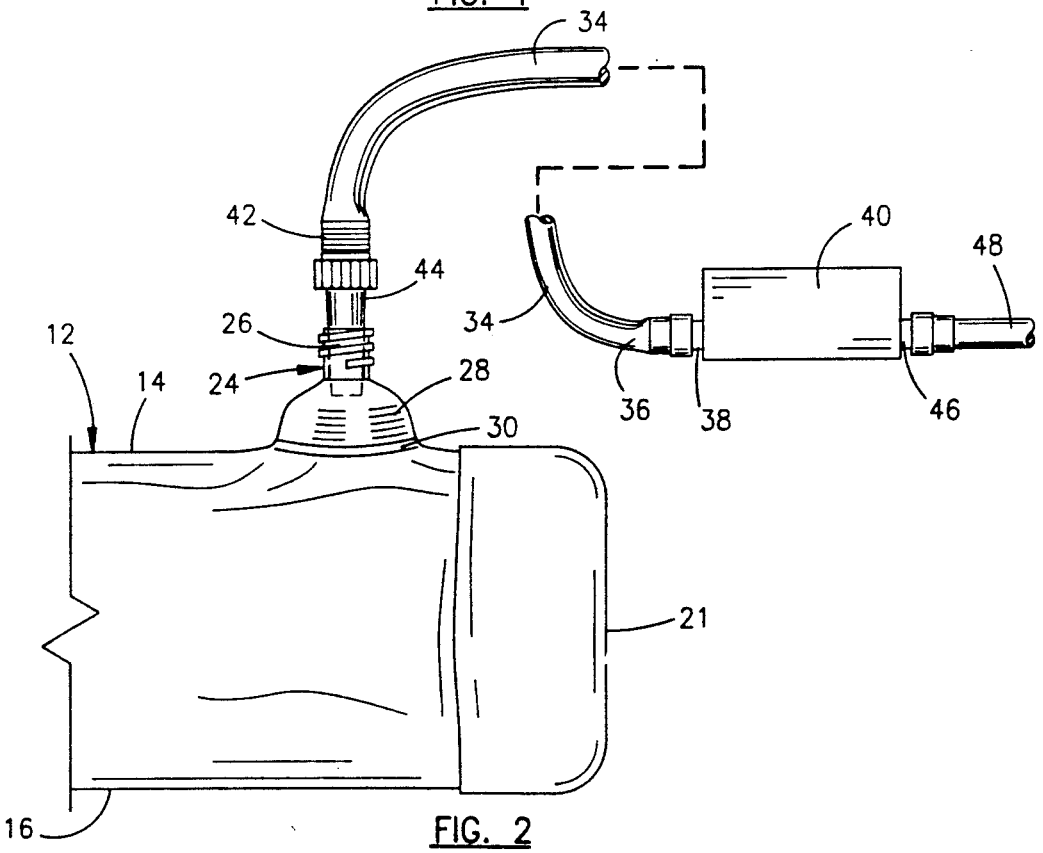
FIG. 2 is an enlarged side view of the connection between a hose and mattress filler opening.

In FIGS. 1 and 2, there is shown a filler opening 24 through top wall 14. The filler opening is defined by a threaded generally tubular collar 26 which extends upwardly from a flexible skirt 28 having an outer periphery 30 thermowelded to top wall 14. The filler opening 24 is adapted to receive a removable plug and threaded cap 32 for closing it when the mattress is not being filled or drained. Flexible skirt 28 enables the filler opening collar 26 to be pulled upwardly to the raised drain position of FIGS. 1 and 2, or depressed into the bladder below the surface of top wall 14 during normal usage of the mattress.

FIG. 2 shows a conventional water hose 34 having one end 36 threaded onto the inlet port 38 of water pump 40 and the opposite end 42 threaded onto an elongated generally conical drain insert 44 which is adapted to be press fit into filler opening collar 26 to form a fluid tight connection therebetween for filling and draining the waterbed mattress. The outlet port 46 of pump 40 may be connected by a second hose 48 to any suitable drain. The pump 40 may be any of the commercially available water pumps manufactured and sold for draining waterbeds.

Figure 6:
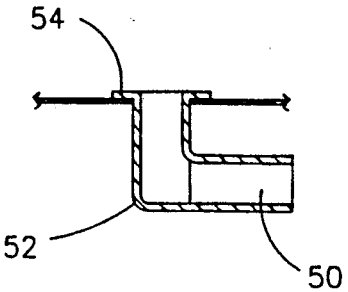
FIG. 6 is a detailed sectional view of one embodiment of a vacuum relief valve of the invention.

FIG. 6 illustrates a vacuum relief valve $o sealed within a generally L-shaped tube 52 having a mounting flange 54 at the open top end thereof. The tube 52 is preferably formed of a flexible plastic and the flange 54 is thermowelded to top wall 14. The L-shaped tube 52 minimizes protrusion of the vacuum relief valve below the surface of top wall 14. The vacuum relief valve 50 is press fit and/or adhesively bonded within tube 52 so that fluid flow through the tube is controlled by the vacuum relief valve 50. Vacuum relief valve 50 may be of any commercially available type which is biased to a closed position, but which opens in response to vacuum pressure exceeding a predetermined level. The simple cylindrical shape of vacuum relief valve 50 is preferred, but valves of other shapes may be appropriately sealed and mounted relative to a mattress wall for use according to the invention. Likewise, whereas a conventional spring biased valve is preferred for purposes of durability and economy, any other type of vacuum relief valve could be substituted.

Figure 3:
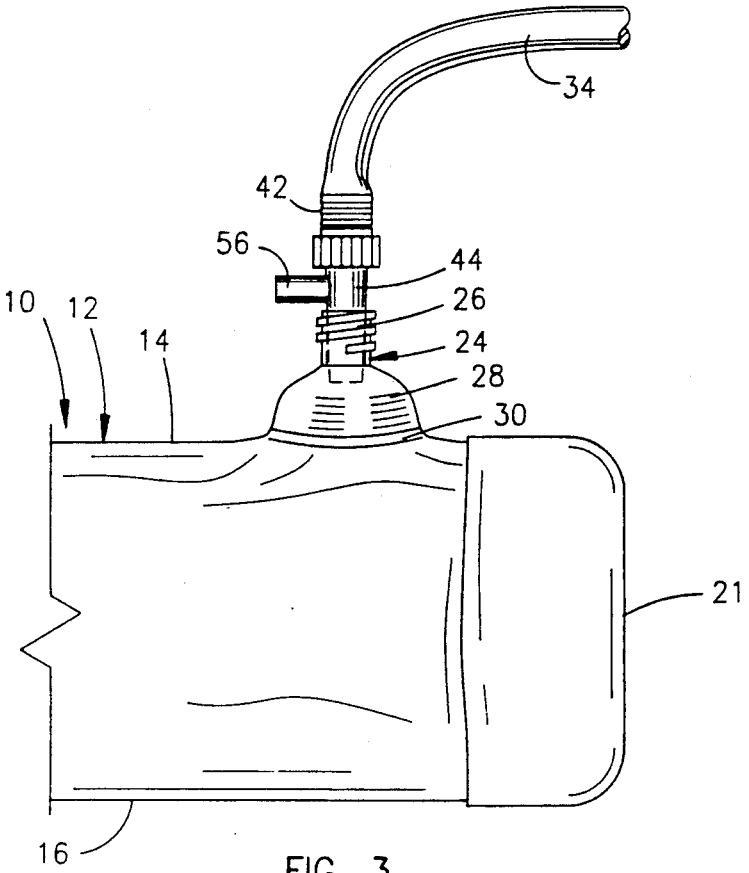
FIG. 3 is a side elevational view, similar to FIG. 2, but including a vacuum relief valve mounted on the drain insert of the hose.
Figure 4:
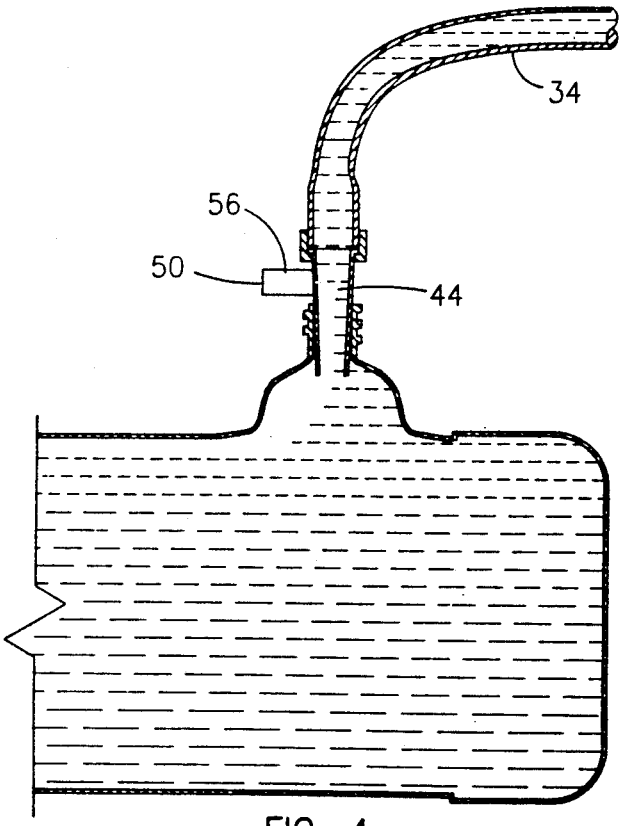
FIG. 4 is a partial side sectional view showing water being pumped from the waterbed mattress bladder for draining it.
Figure 5:
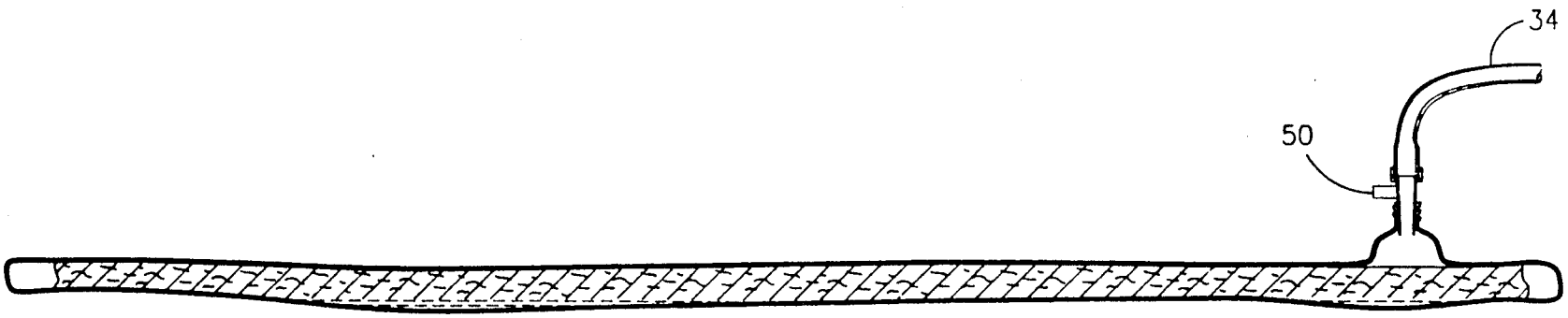
FIG. 5 is a side sectional view of a waterbed mattress bladder drained in accordance with the system of the invention.

FIG. 3 illustrates an alternate embodiment wherein the vacuum relief valve 50 is sealed within a tubular nipple 56 surrounding an opening through the sidewall of drain insert 44. The nipple $6 and vacuum relief valve 50 are situated longitudinally on the insert 44 so as not to interfere with either the connection of the insert to the hose 34 or with full insertion of the insert into the filler opening collar 26.

In another embodiment of the invention, it is contemplated that the vacuum relief valve could be incorporated into the water pump 40 at a position to enable air to be bled back through the hose and into the filler opening in response to vacuum pressure within the bladder exceeding a predetermined level.

The vacuum relief valve 50 is preferably such that it enables air to be bled into the waterbed bladder 12 when the vacuum pressure Within the bladder exceeds a predetermined level between 5 and 15" of mercury vacuum pressure. In one embodiment, the predetermined level of vacuum pressure for the vacuum relief valve was four pounds (4 lbs.) per square inch vacuum pressure. These levels enable the pump to induce sufficient vacuum for collapsing any foam, fiber, springs, or other inserts within the mattress bladder for compact shipping and storage. Vacuum pressure beyond that required for collapsing the contents of the bladder tends to arrest drainage of water from the mattress, typically at a stage where perhaps ten (10) gallons of water remains within the mattress and the combination mattress and remaining water weigh approximately one hundred ten pounds (110 lbs.).

In operation, draining the filled waterbed mattress 10 is accomplished by connecting the one end 36 of water hose 34 to the inlet port 38 of water pump 40 and connecting the opposite end 42 of the hose to the filler opening 24 of mattress 10. That connection is facilitated by the use of drain insert 44 which enables a simple press fit of the hose into the filler opening 24. The second hose 48 is connected between the outlet port 46 of pump 40 and any suitable drain, such as a sink, toilet, bathtub, shower, or the like.

Upon activation of pump 40, water is drawn from the mattress through filler opening 24, hose 34, pump 40 and hose 48 to the drain. The bladder 12 collapses as water is withdrawn from it. As the mattress becomes substantially emptied, the internal vacuum pressure increases. Vacuum relief valve 50 prevents that internal pressure from prematurely reaching the extent that drainage is arrested. Rather, vacuum relief valve 50 bleeds sufficient air back into the mattress to enable continued drainage to an extent where only approximately one or two gallons of water may be left in the mattress and the combination mattress and any remaining water weigh approximately fifty pounds (50 lbs.). This represents a a substantial improvement over the approximately one hundred ten pound (110 lb.) weight of a mattress drained without any bleeding of air into the mattress and a still very substantial improvement over the approximately seventy pound (70 lb.) weight of a mattress drained by a skilled operator who manually lets air back into the mattress without losing the prime on pump 40.

An important feature of the present invention is that it operates automatically without any input from the one emptying the waterbed mattress. In fact, the vacuum relief valve 50 will operate effectively even if the operator doesn't know it is there and connects the mattress to the pump in the conventional manner for draining waterbeds. As the mattress is emptied and the internal vacuum pressure increases above the predetermined level of the vacuum relief valve, the valve bleeds air back into the bladder until the vacuum pressure is lowered to the predetermined level, enabling continued drainage without interruption and without any skill, attention or handling by the operator.

Figure 8:
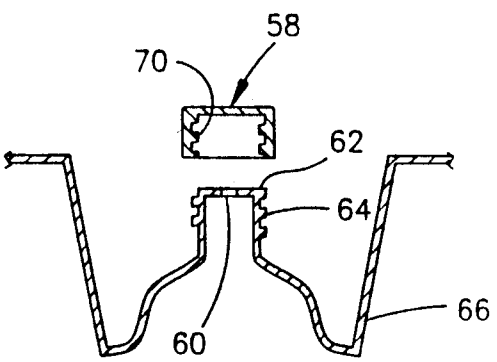
FIG. 8 is a side sectional view of the orifice-type vacuum relief valve of FIG. 7.
Figure 7:
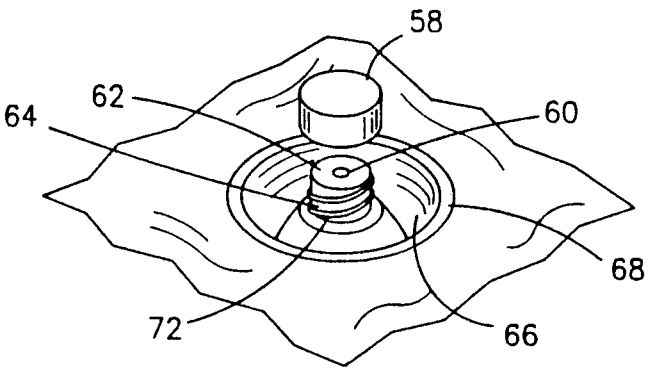
FIG. 7 is a partial detailed perspective view of a manually closeable orifice-type vacuum relief valve.

FIGS. 7 and 8 illustrate a simplified embodiment of the invention wherein the vacuum relief valve comprises a combination cap 58 and orifice 60 formed in the top wall 62 of a tubular collar 64 which merges with a flexible skirt 66 having a peripheral edge 68 thermowelded to the bladder top wall 14, much like the conventional filler opening 24. Cap 58 has internal threads 70 which engage external thread 72 on collar 64 for closing and sealing cap 58 onto the collar when the orifice is to be covered and closed. Orifice 60 has a diameter, on the order of approximately 1/16" in one embodiment, that is matched to the pumping action of the drain pump to allow air to bleed back into the bladder through the orifice when vacuum pressure is built up within the mattress by the water pump. If the orifice diameter is matched with the pump capacity, it is anticipated that a waterbed mattress equipped with the orifice illustrated in FIGS. 7 and 8 can be drained in the same manner described in connection with the previous embodiments including the spring biased vacuum relief valve. The cap 58 is effective to close and seal the orifice so as to prevent fluid communication therethrough between the ambient atmosphere and bladder during normal usage of the mattress.

Whereas the invention has been shown and described in connection with preferred embodiments thereof, it is understood that many modifications, additions and substitutions may be made which are within the intended broad scope of the appended claims.

I claim:

1. In combination, a waterbed mattress bladder having top, bottom and peripheral side walls and a filler opening in one wall thereof, a water pump having inlet and outlet ports, a drain hose operatively connected to and extending between said filler opening and said inlet port of said water pump whereby operation of said pump causes water to be drawn from said bladder through said hose and pump, a vacuum relief valve closed in its inactive mode, operatively associated with at least one of said bladder or hose to automatically provide air flow into said bladder upon the vacuum pressure within said bladder exceeding a predetermined level.

2. The combination of claim 1 wherein, said predetermined level for said vacuum relief valve is between five and fifteen inches of mercury vacuum pressure.

3. The combination of claim 1 wherein, said predetermined level of vacuum pressure for said vacuum relief valve is approximately four pounds per square inch vacuum pressure.

4. The combination of claim 1 wherein said vacuum relief valve is mounted on a wall of said bladder in spaced relation from said filler opening.

5. The combination of claim 4 wherein said filler opening and vacuum relief valve are both mounted on said top wall of said bladder.

6. The combination of claim 1 wherein said hose further comprises a drain insert adapted for sealed engagement within said filler opening for drawing water from said bladder, said vacuum relief valve being mounted on said drain insert.

7. The combination of claim 6 wherein said vacuum relief valve is mounted on said drain insert at a position above the extent of insertion of said drain insert into said filler opening to avoid interference with the sealed engagement of the insert within said filler opening.

8. The combination of claim 7 wherein said drain insert is adapted to be press fit into said filler opening.

9. The combination of claim 8 wherein said drain insert comprises a tube tapering toward one end thereof.

10. A method of draining water from a filled waterbed mattress bladder having a filler opening through one wall thereof, comprising, providing a hose and a water pump having inlet and outlet ports, said hose having one end connected to the inlet port of said water pump, connecting the opposite end of said hose to said filler opening in generally sealed relation for drawing water from the bladder through said filler opening and hose, providing a vacuum relief valve, closed in its inactive mode, in operative association with at least one of said bladder or hose, operating said water pump to drain water from said bladder through said hose, and automatically introducing air into the bladder through said vacuum relief valve upon the vacuum pressure within said bladder exceeding a predetermined level.

11. The method of claim 10 wherein said step Of automatically introducing air into the bladder occurs upon the vacuum pressure within the bladder exceeding a predetermined level between five inches and fifteen inches of mercury vacuum pressure.

12. The method of claim 10 wherein said step of automatically introducing air into the bladder occurs upon the vacuum pressure within said bladder exceeding approximately four pounds per square inch vacuum pressure.

13. The method of claim 10 further comprising mounting said vacuum relief valve on said bladder in spaced relation from said filler opening.

14. The method of claim 10 further comprising connecting a drain fitting to the opposite end of the hose to facilitate connecting the hose to the filler opening and mounting said vacuum relief valve on said drain fitting at a position to avoid interference with the sealed connection between said drain fitting and filler opening.

15. In combination, a waterbed mattress bladder having top, bottom and peripheral side walls and a filler opening in one wall thereof, a siphon hose having one end operatively connected to and extending from said filler opening whereby upon filling said siphon hose with water and placing the opposite end of the hose below said filler opening, water is drawn from said bladder through said siphon hose, a vacuum relief valve, closed in its inactive mode, operatively associated with at least one of said bladder and hose to automatically provide air flow into upon the vacuum pressure within said bladder said bladder exceeding a predetermined level.

16. A waterbed mattress, comprising a bladder having top, bottom and peripheral side walls, a filler opening in wall of said bladder, said filler opening being adapted for connection to one end of a hose for draining water from the bladder, and a vacuum relief valve, closed in its inactive mode, mounted on one wall of said bladder and being operative to provide air flow into said bladder upon the vacuum pressure within said bladder exceeding a predetermined level.

17. The waterbed mattress of claim 16 wherein said vacuum relief valve is mounted on the top wall of said bladder.

18. The waterbed mattress of claim 16 wherein said vacuum relief valve comprises an orifice through said bladder, and cap means operatively associated with said orifice and adjustably mounted on said bladder for movement between positions blocking and enabling fluid communication between said orifice and the ambient atmosphere.

* * * * *